US006098374A

United States Patent [19]

Yates et al.

[11] Patent Number: 6,098,374

[45] Date of Patent: Aug. 8, 2000

[54] ENVELOPE OPENING APPARATUS

[75] Inventors: Keith Yates, Great Dunmow; Ernest Spick, Bishops Stortford, both of United Kingdom

[73] Assignee: Pitney Bowes Inc., Stamford, Conn.

[21] Appl. No.: 09/134,640

[22] Filed: Aug. 14, 1998

[51] Int. Cl.[7] ..... B65B 43/26

[52] U.S. Cl. ..... 53/381.6; 53/381.5; 53/569

[58] Field of Search ..... 53/381.5, 381.6, 53/284.3, 569, 570, 381.7, 381.3, 460; 414/411, 412; 493/259, 257, 255

[56] References Cited

U.S. PATENT DOCUMENTS 5,156,515 10/1992 Charron et al. ..... 414/412
5,487,254 1/1996 Dronsfield ..... 53/381.5
5,630,312 5/1997 Ballard et al. ..... 53/381.5
5,660,030 8/1997 Auerbach et al. ..... 53/381.5
5,675,959 10/1997 Hamma et al. ..... 53/381.5
5,715,648 2/1998 Yates ..... 53/381.5

*Primary Examiner*—Linda Johnson
*Assistant Examiner*—Matthew Luby
*Attorney, Agent, or Firm*—Christopher J. Capelli; Melvin J. Scolnick

[57] ABSTRACT

Disclosed herein is an envelope opening apparatus, preferably for use in an inserter (210). The envelope opening apparatus comprises means (54) for locating an envelope, having rear and front panels (116, 118) and a flap (64) hinged to the front panel, in a waiting position with its flap in an open position in substantially the same plane as its front panel, and means (60, 62, 68, 70) operable for forming a step-like deformation in the flap, so as to cause the rear panel (116) to separate from the front panel (118).

4 Claims, 12 Drawing Sheets

ENVELOPE OPENING APPARATUS

CROSS REFERENCE TO RELATED APPLICATIONS

Reference is made to commonly assigned co-pending patent applications: Ser. No. 09/134,644 filed herewith entitled "An Inserter for Inserting Documents Into Envelopes in the name of Keith Yates; Ser. No. 09/134,642 filed herewith entitled "Document Transporting Apparatus in the names of Graham Cook and Joan Doutney; Ser. No. 09/134, 641 filed herewith entitled "Envelope Inserting Apparatus" in the name of Keith Yates.

The instant invention relates to apparatus for opening envelopes and may form part of apparatus for inserting documents into envelopes.

Envelope inserting apparatus is well known and involves inserting paper documents into a waiting envelope that has had its front and rear panels spread apart to receive the insert material. In the inserting station, the envelope arrives first and is typically opened by a combination of devices which may include bending rolls and hold-down fingers. The contents to be inserted then arrive through a second path and are driven into the envelope. Typically, the last part of the inserting motion is accomplished ballistically for about 0.5° to 0.8° using the kinetic energy of the inserts. Reliability problems exist with this system because the envelope does not always open sufficiently, and, due to the bent nature of the envelope, drag is created on the insert material preventing it from reaching the bottom of the envelope.

Apparatus which positively opens the envelope and holds the envelope open, thereby greatly reducing the amount of drag on the insert material and assuring that the insert material is reliably inserted into the waiting envelope, is known from the present applicants' EP-A-0 785 092. In this apparatus, a waiting envelope is supported in a substantially horizontal plane with its back panel situated above its front panel and the envelope flap in its open position and substantially in the plane of the front panel. A pair of hold-down fingers presses the envelope flap from above against the inboard ends of respective pivotable paddles having an interior leg and an exterior leg angled out of the plane of the interior leg, to cause the flap to be bowed downwardly. This causes the rear panel to "pop" upwardly, thereby opening the envelope ready for an insert or insert collation to be inserted.

Whilst such an arrangement can be designed to operate effectively, there can be a tendency, under certain circumstances such as depending on the envelope construction, grade of paper used to make the envelope, etc., for the envelope rear panel to "pop" downwardly, or "reverse-throat", when the flap is bowed downwardly, so that the envelope mouth remains closed.

It is an aim of the present invention to provide an envelope opening apparatus whose operation is improved in this respect.

According to the invention, there is provided envelope opening apparatus comprising:

means for locating an envelope, having rear and front panels and a flap hinged to the front panel, in a waiting position with its flap in an open position in substantially the same plane as its front panel, and means operable for forming a step-like deformation in the flap, so as to cause the rear panel to separate from the front panel.

It has been found that the formation of the step-like deformation helps to avoid reverse throating of the envelope.

In accordance with a simple and effective arrangement, the flap deforming means comprises at least one step-shaped member located on one side of the flap and a respective finger member on the other side of the flap, one of said members being movable towards the other member to form said step-like deformation in the flap. To obtain reliable throating of the envelope, preferably the flap deforming means comprises a flipper which is pivotably mounted so as to have an inboard leg and an outboard leg, the inboard leg being formed with a step at its inboard end and the finger member being movable towards said step to form said step-like deformation in the flap while the inboard and outboard legs of the strip-like member deflect the portion of the flap located outboard of the finger member out of the plane of the flap at the outboard side of the finger member. It is also preferred for the inboard end of the flipper to carry a friction pad.

According to a convenient arrangement for returning the flipper to its waiting position ready for the next envelope to be throated, the flipper is spring-biased such that when the finger member is moved away from the flipper step, the flipper pivots into an inoperative position in which it is out of contact with the envelope.

It is preferable for additional measures to be adopted to augment the throating operation and minimise the risk of reverse throating. In accordance with one such measure, the envelope opening apparatus further comprises means for arching the front panel of the envelope away from its rear panel. This helps to cause the rear panel to "pop" up away from the front panel. Another measure is the use of at least one horn that is operable to be displaced between the separated front and rear panels and then displaced to further separate the rear panel from the front panel.

For a better understanding of the invention and to show how the same may be carried into effect, reference will now be made, by way of example, to the accompanying drawings, in which.

Figure 1:
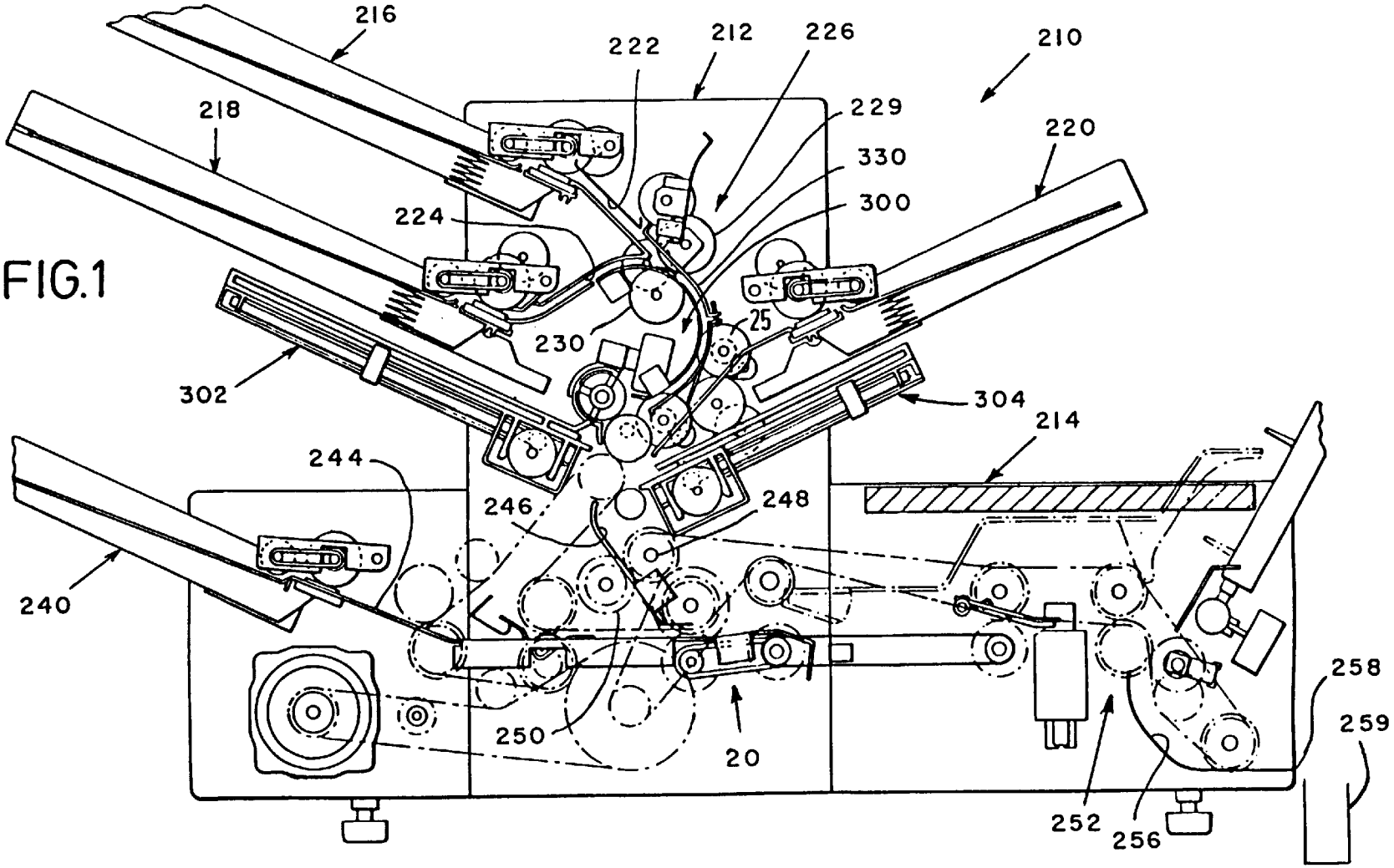
FIG. 1 is an elevational view of a document inserting system incorporating an envelope opening apparatus forming an embodiment of the present invention.
Figure 2:
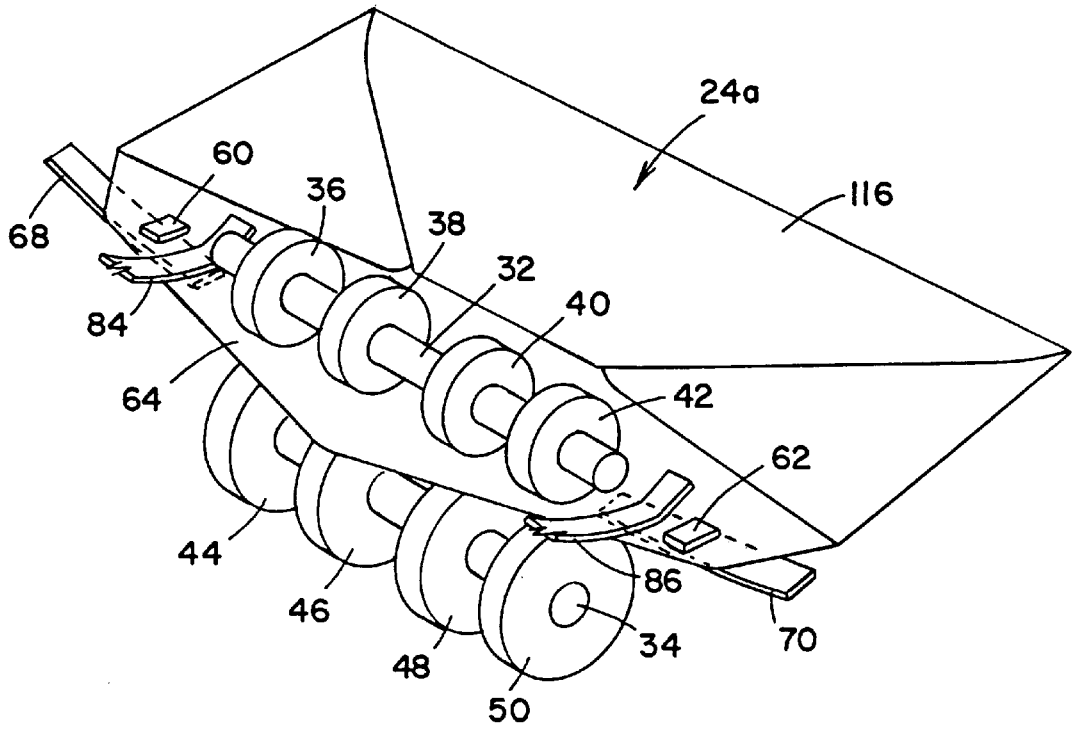
FIG. 2 is a perspective view of the envelope opening apparatus showing opening horns about to enter the envelope.
Figure 3:
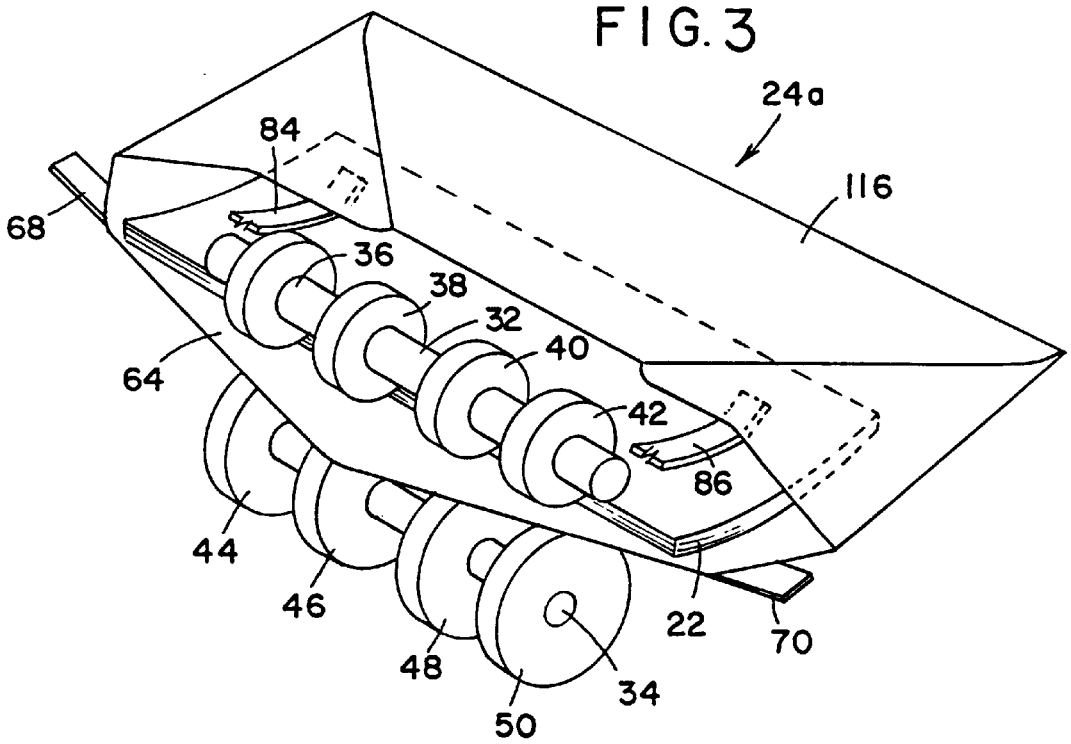
FIG. 3 is similar to FIG. 2 but shows the opening horns fully engaging the envelope and enclosure documents being inserted into the envelope.

Reference is made to the drawings, wherein there is seen in FIG. 1 an elevational view of a tabletop inserter, designated generally at 210, incorporating an envelope opening apparatus forming an embodiment of the invention and located at insertion station 20. It is to be appreciated that reference is made to the inserter system 210 of FIG. 1 only to show an exemplary environment of implementation for this envelope opening apparatus. Thus, inserter system 210 is not to be understood to be the only environment for use for the envelope opening apparatus as one skilled in the art could readily implement the below described envelope opening apparatus in various inserter systems requiring an envelope opening apparatus or in any mechanism requiring an apparatus for opening envelopes. Therefore, in order not to obscure the description of the envelope opening apparatus, only a simplified description of the inserter system 210 depicted in FIG. 1 will be provided. For a more detailed description, reference is made to EP-A-0 700 794 assigned to the present applicants.

With reference to FIG. 1, tabletop inserter 210 generally consists of an upper housing 212 mounted atop a lower housing 214. Upper housing 212 generally includes first and second sheet feeders 216 and 218, and preferably an insert feeder 220. Individual sheets are preferably conveyed from each sheet feeder 216 and 218 into respectively first and second feed paths 222 and 224. The first and second sheet paths 222 and 224 merge with one another at a collation station 226 having first and second collating rollers 229 and 230. The collating station 226 is operative to align the leading edges of first and second sheets being respectively conveyed from the first and second sheets feeders 216 and 218, via the first and second sheet paths 222 and 224, within the nip formed between the collating rollers 229 and 230. Once aligned, the collating rollers 230 and 229 are actuated to simultaneously feed the aligned sheets in a supply path 330 downstream of the collating station 226. These aligned sheets are also known as a "collation". This sheet collation is then conveyed downstream in the supply path 330 to the folding station 300.

Like conventional folding stations, the folding station is configured to fold the sheet collation in prescribed configurations, such as C-fold, Z-fold, Half-fold, Double-fold etc. In this constructional example, the folding station 300 comprises a first removable fold plate 302 and a second removable fold plate 304. It also includes a diverter which is operable for diverting a sheet approaching the first fold plate 302 directly to the second fold plate 304. Depending on the setting of the diverter, the type of fold that is made can be selected. After a collation is folded in the folding station 300, the folded collation is then conveyed to the lower housing 214 of the inserter system 210 for further processing.

The lower housing 214 of inserter system 210 includes an envelope supply station 240 connecting to insertion station 20. Located at the insertion station is the envelope opening apparatus to be described in detail below. The envelope supply station 240 feeds closed envelopes to the insertion station 20, via envelope feed path 244 preferably. Once received in the insertion station 20 an envelope is opened in preparation for insertion of the aforesaid folded collation being conveyed from the folding station 300. Thus, the folded collation is transported from the folding station 300 to the insertion station 20, via a collation transport path 246 connecting the latter two stations. Preferably the collation transport path 246 includes a pair of conveying rollers 248 and 250 for conveying a folded collation along the transport path 246.

The lower housing 214 further includes a sealing station 252 located downstream of the insertion station 20, which sealing station 252 is operative to seal an open envelope received from the insertion station 20. An envelope insertion path connects the insertion station 20 to the sealing station 252. An envelope output path 256 connects to the sealing station 252 and is operative to convey sealed envelopes from the sealing station 252 through an output opening 258 provided in the lower housing 214 of the insertion system 210. After a sealed envelope has exited from the output opening 258, appropriate postage can then be applied for delivery to a recipient.

As is conventional, inserter system 210 includes a control system (not shown) for controlling the various components implemented in the inserter system. It is to be appreciated that the control system is to encompass a computer processor driven system.

With the general structure of inserter system 210 being described above, a more specific description will now be given regarding the insertion station 20 of the preferred embodiment.

Figure 9:
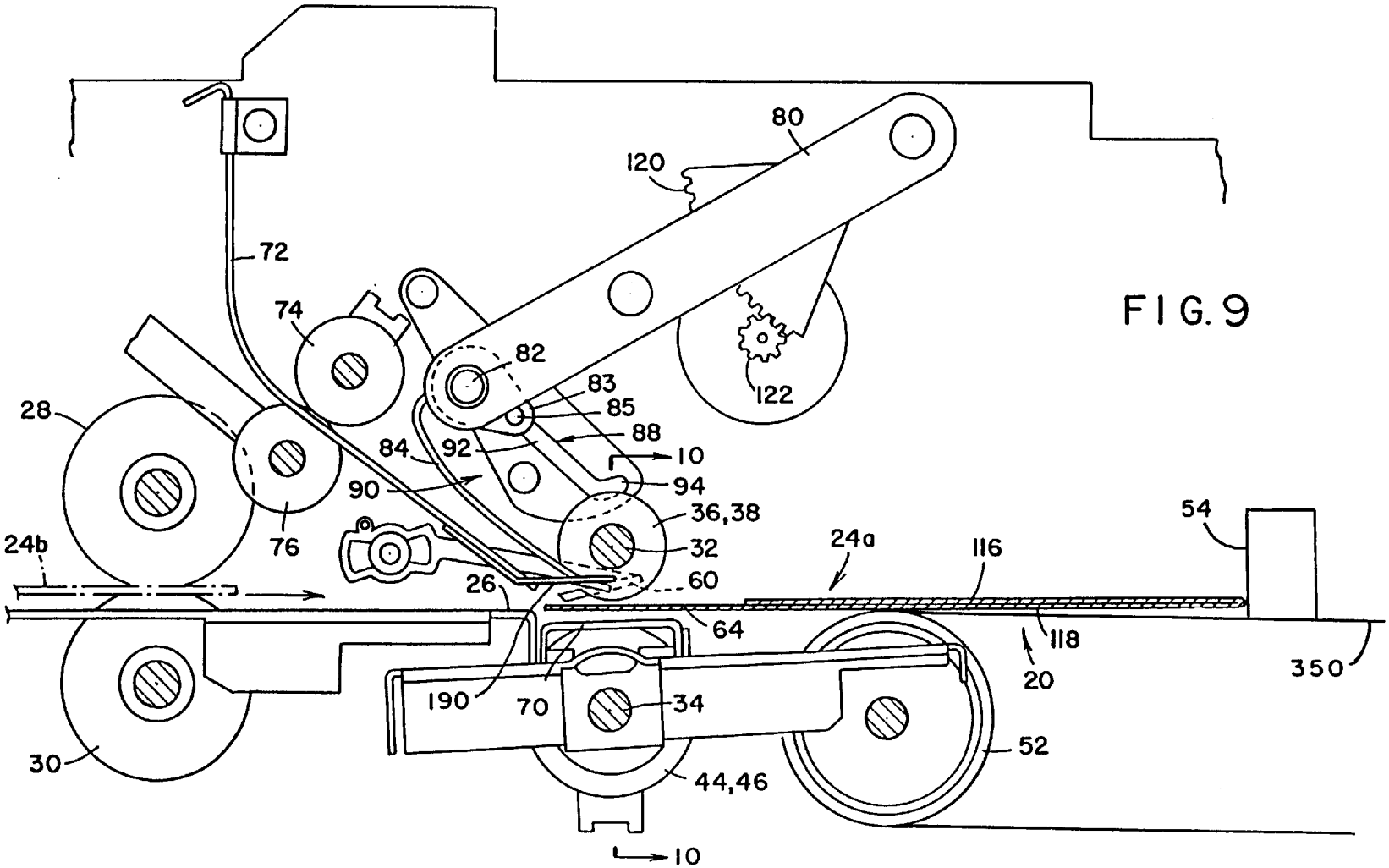
FIG. 9 is a side, elevational view of the inserting apparatus in accordance with the instant invention, showing an envelope prior to being opened for insertion.

There is seen in FIG. 9 the inserting station generally designated 20 for inserting paper documents 22 (see FIG. 14) into a waiting envelope 24*a* having its front panel 118 underneath, its back panel 116 uppermost, and its flap 64 open, upwardly facing and in a trailing position. The inserting station 20 includes a supporting deck 26 and a pair of envelope feed rollers 28 and 30 for feeding an envelope 24*b* to the position occupied by the envelope 24*a*. Downstream of the rollers 28 and 30 are a fixed, upper shaft 32 and a vertically translatable, lower, drive shaft 34. The upper shaft 32 supports four, spaced feed rollers 36, 38, 40 and 42 rotatably secured thereto (see FIGS. 2, 3, 7, 10 and 12) while the lower shaft 34 supports four spaced, cooperating drive rollers 44, 46, 48 and 50 respectively fixedly secured to the drive shaft 34. The shaft 34 is mounted in such manner that the drive rollers 44, 46, 48 and 50 can be raised and lowered selectively.

Figure 5:
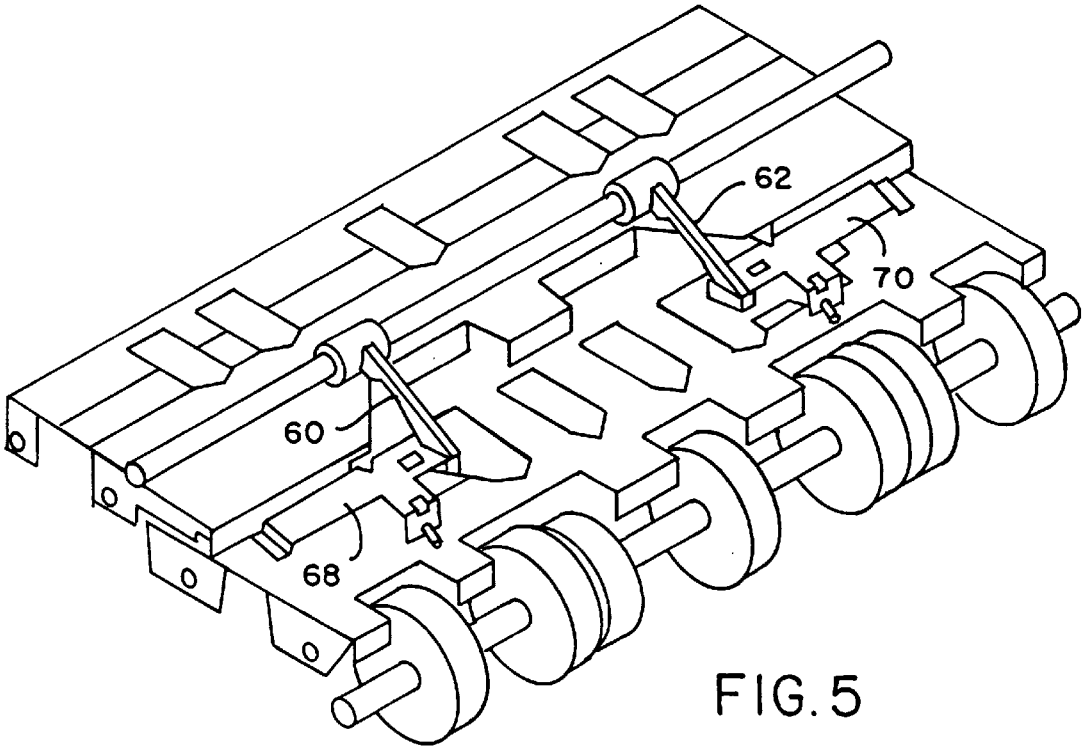
FIG. 5 is a perspective view showing a pair of hold-down fingers associated with a pair of flippers, prior to an envelope being opened.
Figure 6:
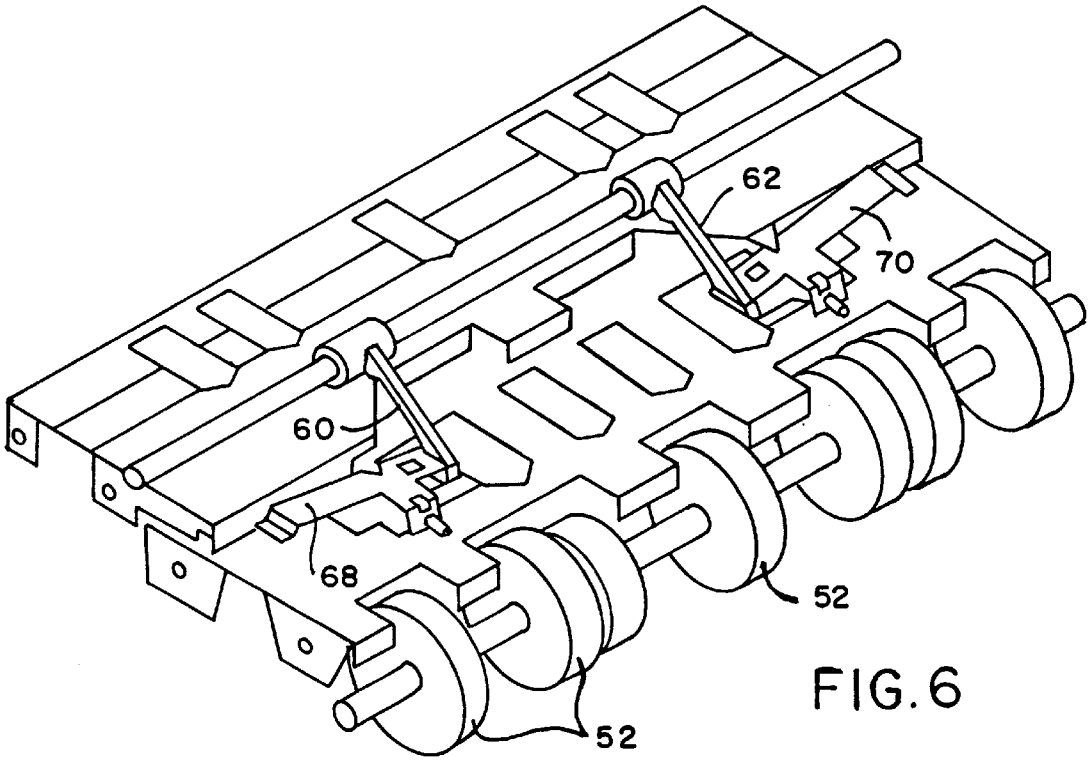
FIG. 6 is a corresponding view to that of FIG. 5 but showing the hold-down fingers in their lower position, for engagement with the envelope flap and for raising the back panel of the envelope.
Figure 7:
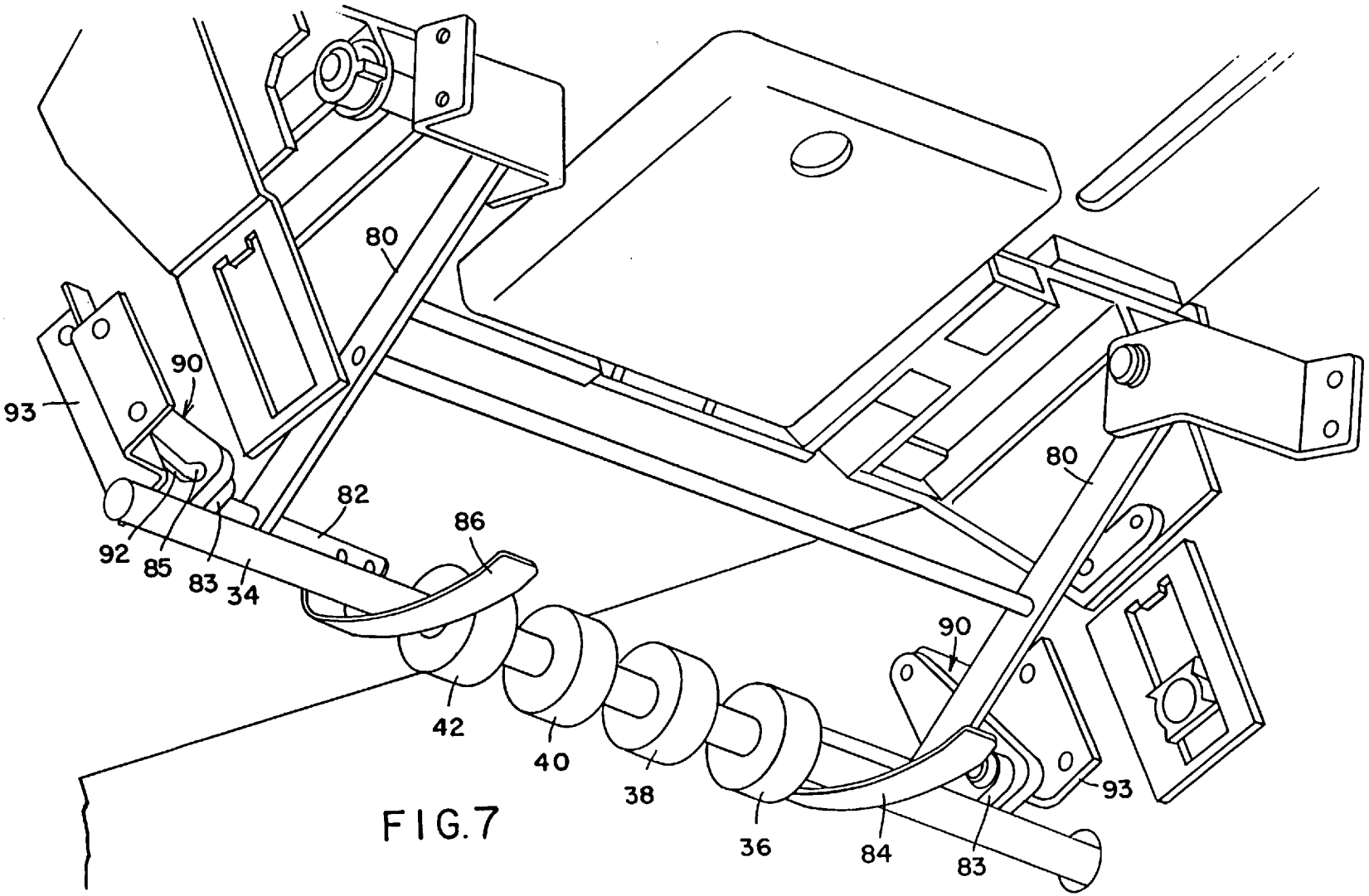
FIG. 7 is a bottom perspective view of the opening horns and associated drive for the horns.
Figure 8:
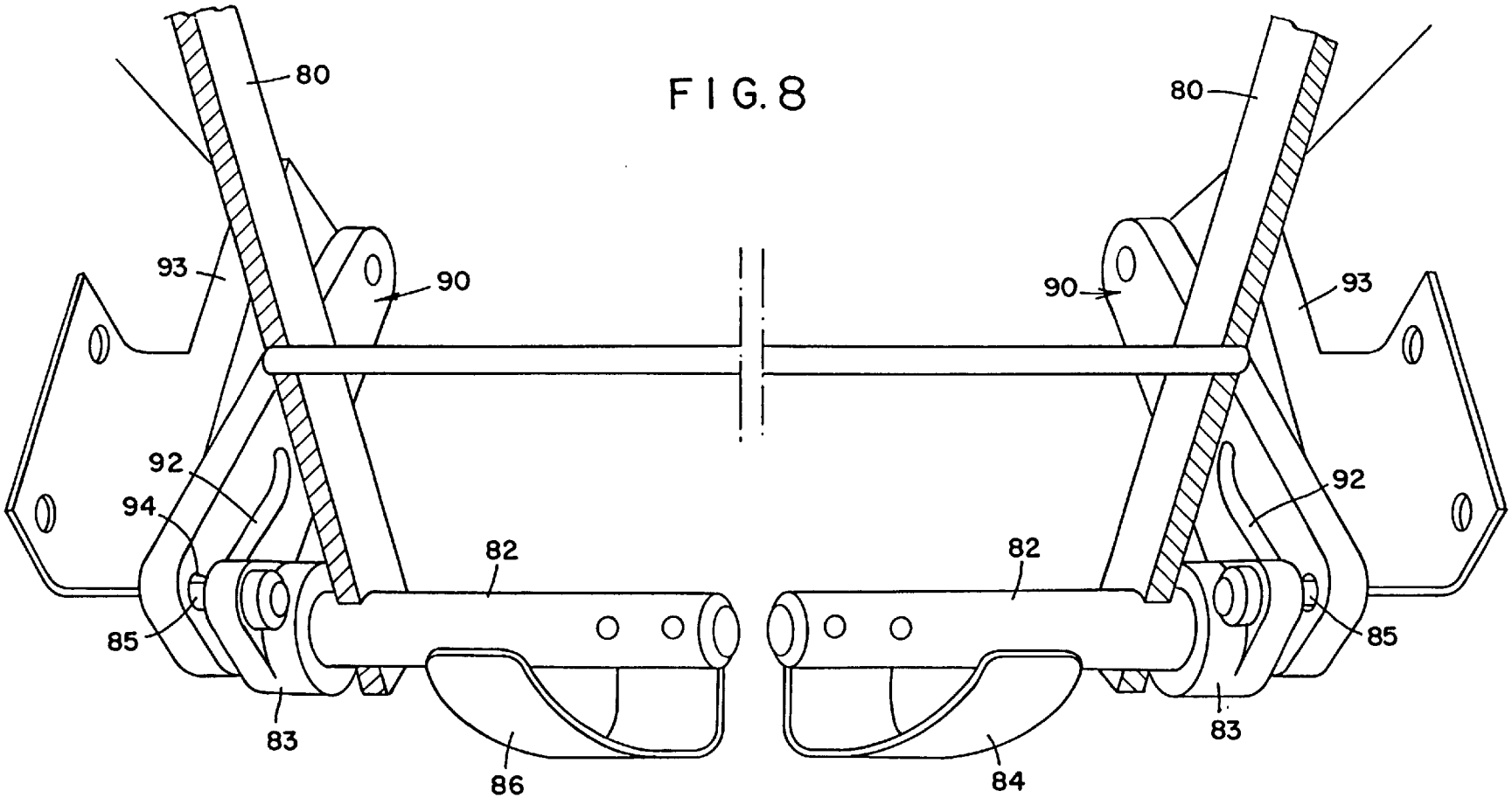
FIG. 8 is a front, perspective view of the opening horns and associated drive apparatus.

Downstream of the shafts 32 and 34 is a bending roll 52 forming part of, and arranged at one end of, a conveyor 350, the roll 52 comprising individual spaced-apart rollers as shown in FIGS. 5 and 6, and further downstream is vertically translatable envelope stop 54.

A pair of pivotable hold-down fingers 60 and 62 (see FIGS. 2, 5 and 9) are situated between the shafts 32 and 34 and above the envelope flap and function, as explained in further detail hereinbelow, to press down on the envelope flap 64 and open the mouth of the envelope. Situated beneath the hold-down fingers 60 and 62 are a pair of flippers 68 and 70 (FIGS. 5 and 9, FIGS. 2 and 3 showing the flippers purely diagrammatically), which cooperate with the fingers 60 and 62 respectively to effect the opening of the mouth of the envelope 24*a* as explained in further detail hereinbelow.

Figure 4:
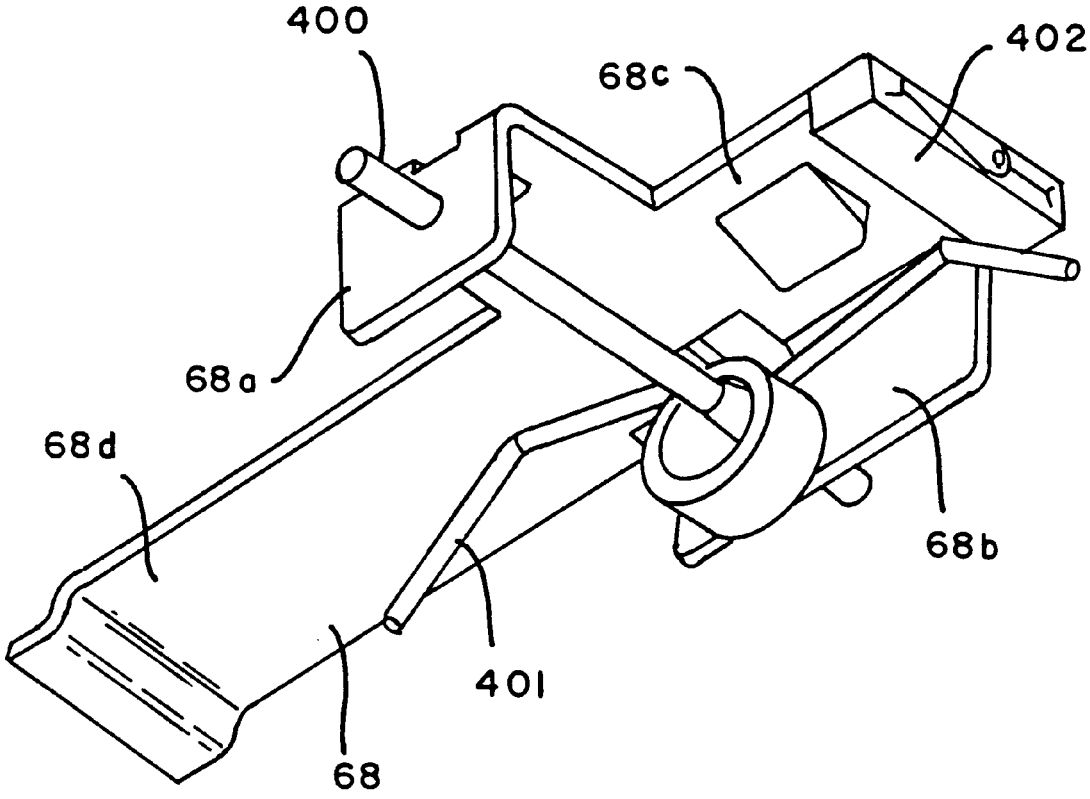
FIG. 4 is a bottom, perspective view of a flipper used in the envelope opening apparatus.
Figure 10:
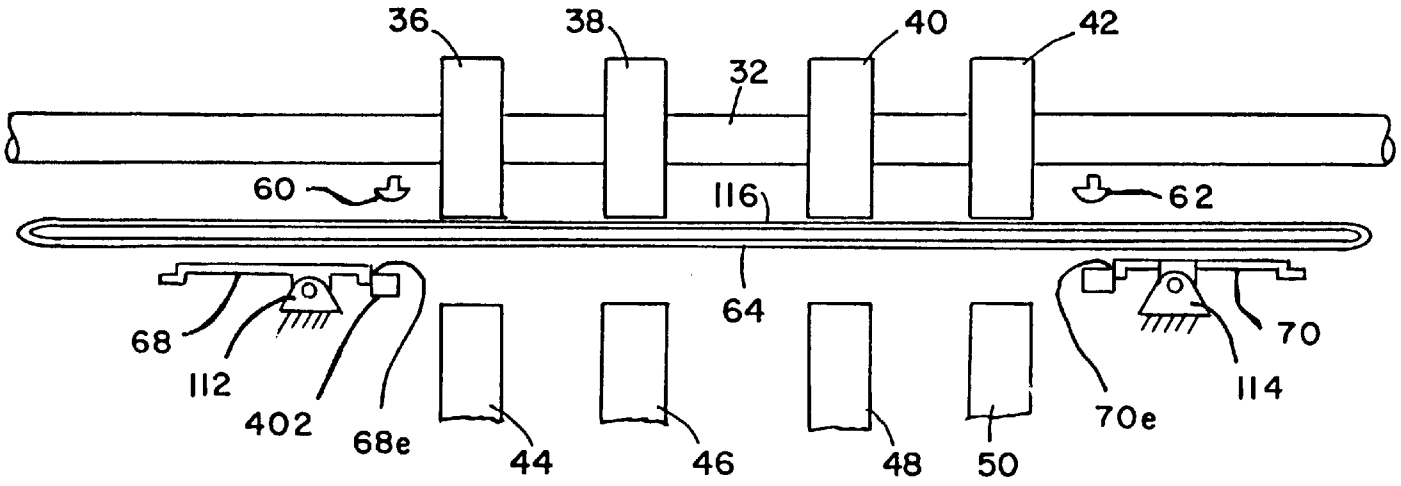
FIG. 10 is a sectional view taken on the plane indicated by the line 10—10 in FIG. 9.
Figure 11:
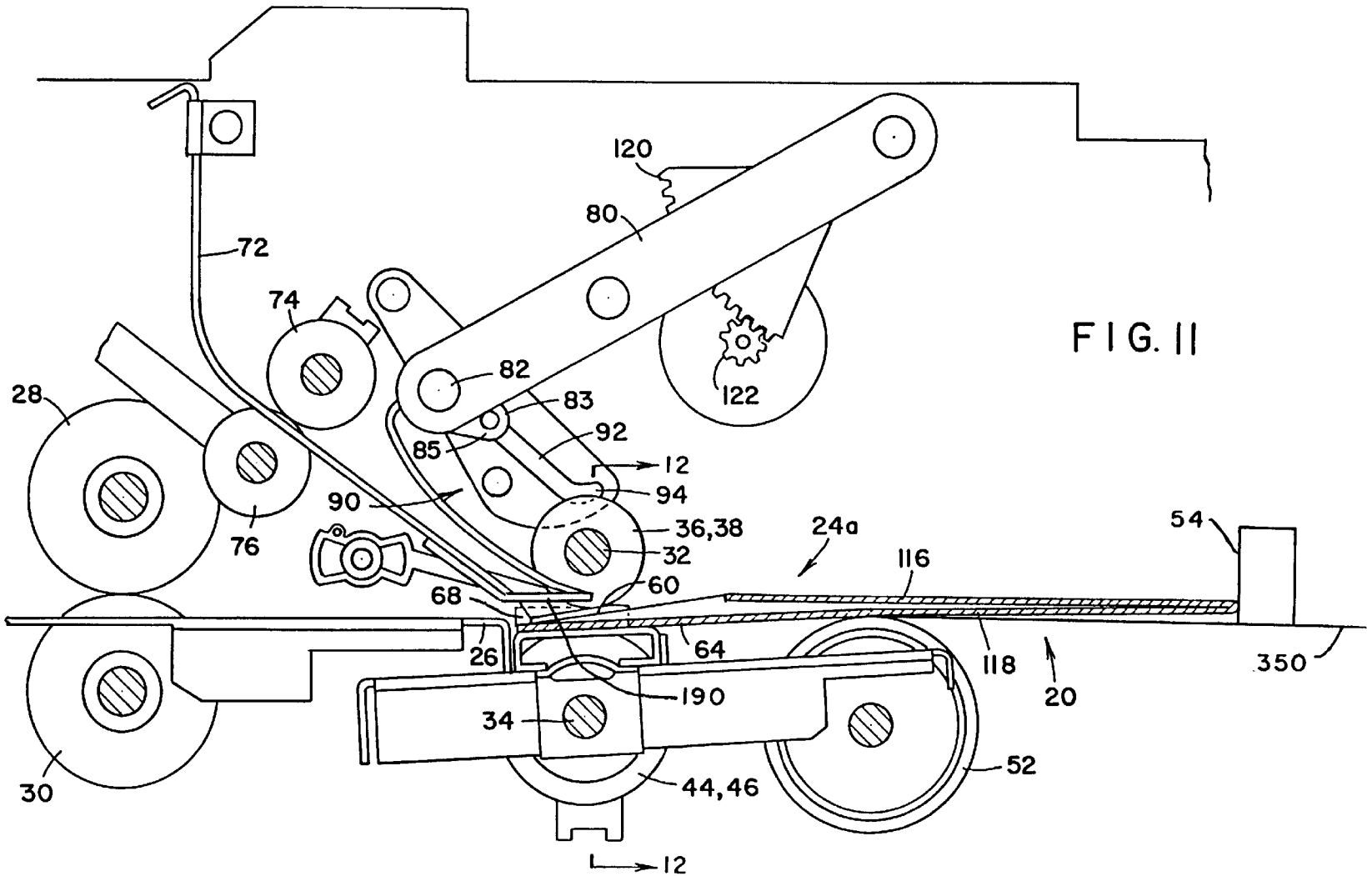
FIG. 11 is similar to FIG. 9 but shows the hold-down fingers rotated to engage the envelope flap and the back panel of the envelope slightly raised.

As best shown in FIG. 4 for flipper 68, each flipper is made from a piece of strip-like metal having a pair of downwardly bent side lugs 68*a*, 68*b*, through which a pivot shaft 400, held in suitable supports 112, 114, (FIG. 10) located slightly inside the outside edges of the envelope and under the envelope flap 64, passes to enable the flipper to pivot about the axis of shaft 400, against the return bias of torsion spring 401, between a normally inoperative position shown in FIGS. 5 and 10 and an operative position shown in FIGS. 6 and 11 in which the envelope throat is opened. The flipper 68 has an inboard leg 68*c* that is located inwardly of the pivot axis of the flipper and an outboard leg 68*d* that is located outwardly of the pivot axis. The inboard leg carries a gripping pad 402 at its inner end whose function is described below. This pad, as shown in FIG. 10, is mounted on an offset angled end portion of the flipper at its inboard end, so that a step 68*e* is formed adjacent the inner end of the inboard leg 68*c*.

Preferably, the pad 402 is made of polyurethane. The flipper 70 is correspondingly constructed and its step is shown at 70*e* in FIG. 10.

The paper documents 22 which are to 5 are to be inserted into the waiting envelope 24*a* are fed by upstream feed apparatus (not shown), such as folding rollers along a chute 72 toward a pair of insert feed rollers 74 and 76 which continue to feed the documents 22 through the opening between the upper rollers 36, 38, 40 and 42 and the lower rollers 44, 46, 48 and 50, which latter are lowered at this time. The momentum given the documents 22 by the feed rollers 36, 38, 40 and 42, due to a leaf spring diagrammatically shown at 190 urging the documents from below against these feed rollers, conveys the documents 22 into the waiting envelope 24*a*.

The insert station 20 further includes a pair of pivotable support arms 80 which rotatably support, at their lower ends, a rotatable shaft 82. A pair of opening horns 84 and 86 are fixedly secured to the laterally extending shaft 82. At the opposite ends of the shaft 82 are a pair of link members 83 each fixedly secured at one end to the shaft 82 and at the other end rotatably secured to a pin 85. Each of the pins 85 travels in groove 88 of a guide member 90 fixedly secured to a bracket 93 (see FIG. 4). The major portion of the groove 88 consists of a straight slot section 92 at its upstream end, while the minor portion of the groove 88 concludes at its downstream end with an angled slot section 94 whose axis is oriented at an angle of about 50 to 70 degrees with the axis of the straight slot section 92. The purpose of the angled slot section 94 will be discussed in greater detail hereinbelow.

The operation of the insertion station 20 will now be described. The envelope feed rollers 28 and 30 cooperate to feed an envelope from the position occupied by envelope 24*b* (see FIG. 9) to the position occupied by envelope 24*a* against the envelope stop 54 in the down position. The drive rollers 44, 46, 48 and 50 are lowered from the feed rollers 36, 38, 40 and 42 respectively, just before the envelope strikes the stop 54. The hold-down fingers 60 and 62 are in a raised position to allow the envelope to pass thereunder, and the flippers 68 and 70 are in a position where their interior ends respectively are raised. The waiting envelope at the insertion station is supported in a substantially horizontal orientation on the upper surface of conveyor 350.

Figure 12:
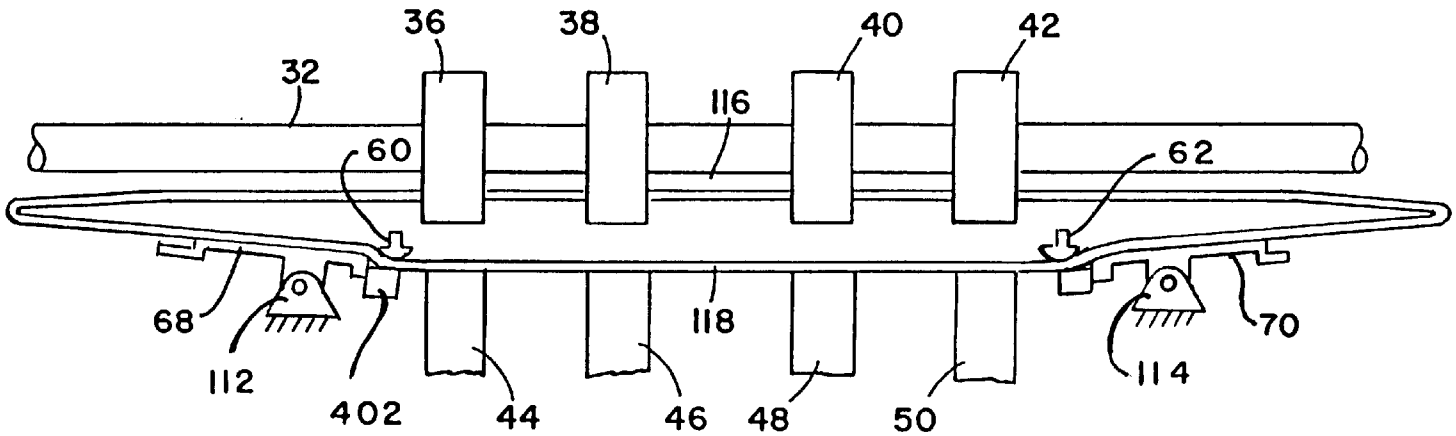
FIG. 12 is a sectional view taken on the plane indicated by the line 12—12 in FIG. 11.

Once the envelope has reached the position of the envelope 24*a*, the hold-down fingers 60 and 62 are rotated downward to the positions seen in FIGS. 6, 11 and 12 against the flippers 68 and 70 respectively, which are thereby caused to pivot against the bias of their torsion springs and pucker the envelope 24*a*, i.e. the envelope front panel 118 (address bearing panel) is separated from the back panel 116 (see FIG. 11).

In this way, the flap 64 is forced downward and the envelope 24*a* is puckered, causing it to open.

It is to be noted that the envelope is opened by the combined action of firstly the step-like deformation to the envelope flap produced by the interaction between the flipper steps 68*e*, 70*e* and the hold-down fingers 60, 62, and secondly the deflection to the portion of the envelope flap located outboard of the corresponding finger 60,62 and in contact with the inboard and outboard legs (68*c*, 68*d* of flipper 68), resulting from the pivoting of the flippers 68, 70 (FIG. 12). In this way, the envelope can reliably be opened without reverse throating of the envelope.

It is further to be noted that the hold-down fingers 60, 62 press the envelope flap 64*a* downwardly against the upper surfaces of drive rollers 44, 46, 48, 50, as shown in FIGS. 11 and 12, so as to arch the front panel of the envelope downwardly, across the upper surface of bending roll 52. This arching helps to ensure that the front and rear envelope panels separate and that the rear panel pops upwardly rather than downwardly.

Figure 13:
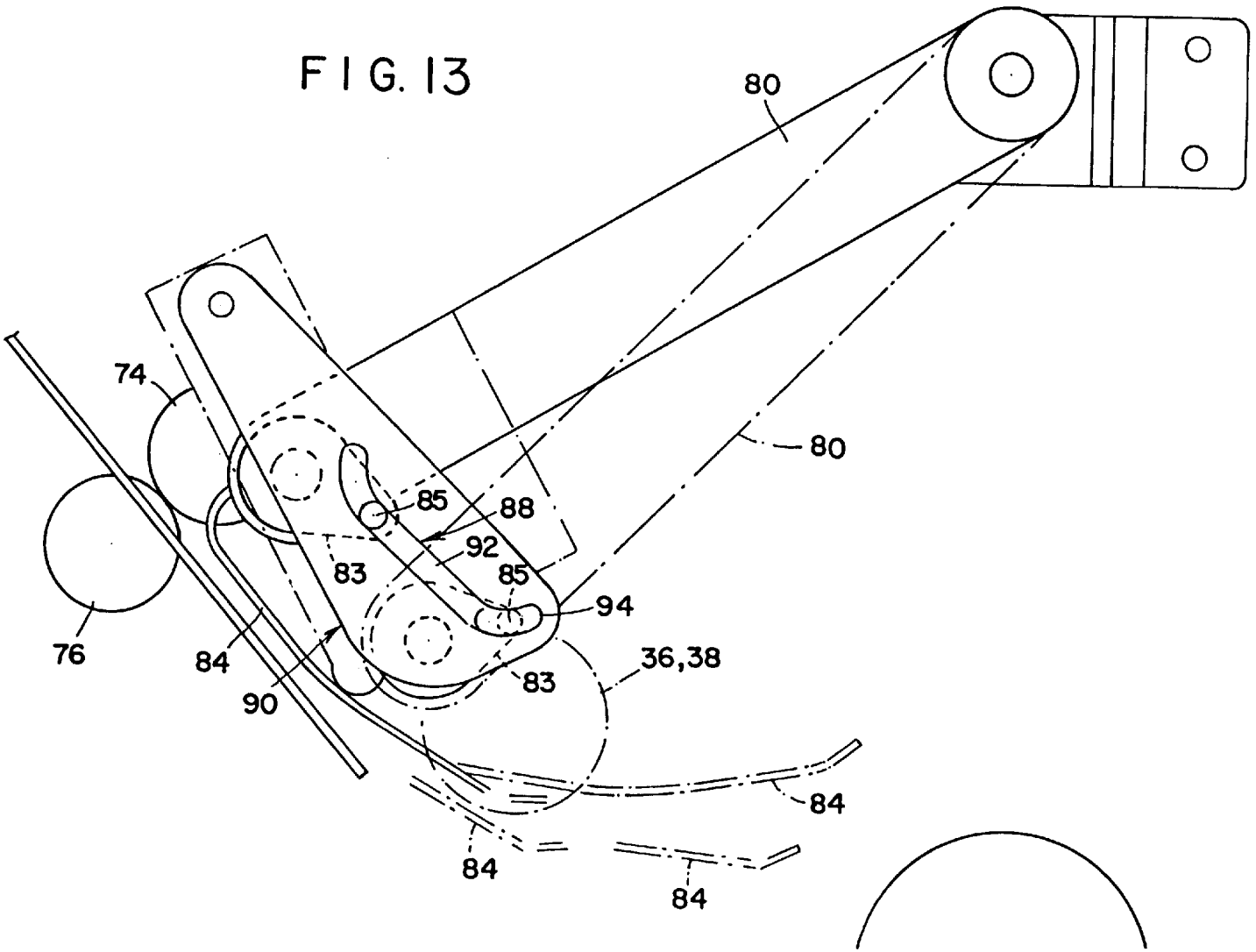
FIG. 13 is a side, elevational view of the opening horns and associated drive at the beginning and end of their cycle.
Figure 14:
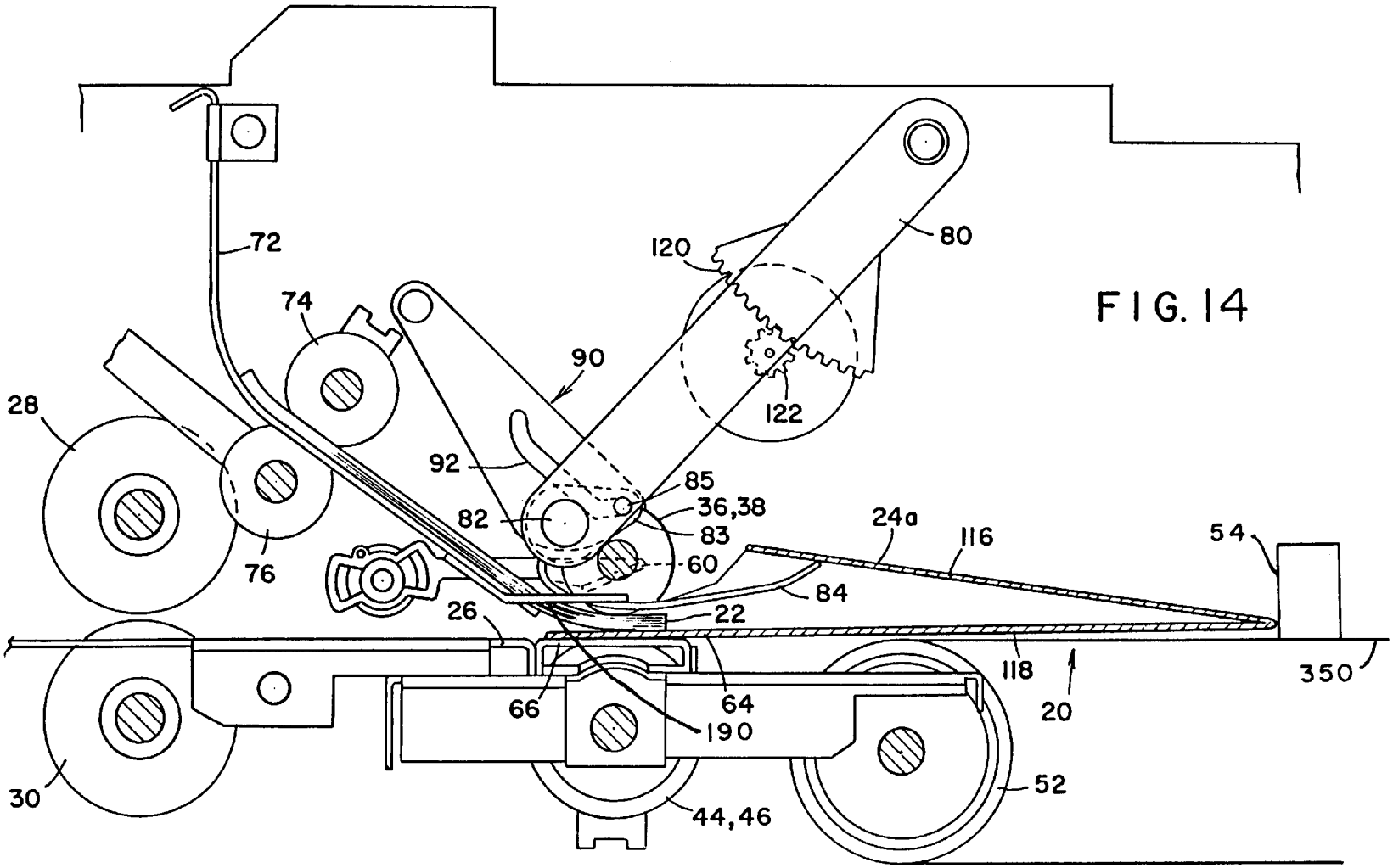
FIG. 14 is similar to FIG. 11 but shows the opening horns at the end of their cycle and the envelope fully opened with enclosure documents starting to be inserted into the fully opened envelope.

Additional separation of the envelope panels 116 and 118 is effected by the opening horns 84 and 86. Once the envelope panels 116 and 118 attain the position seen if FIG. 7, the pivotable supports 80 are rotated about 38 degrees counter-clockwise by a rack 120 and pinion gear 122 from the position seen in FIG. 11 to the position seen in FIG. 14. The counter-clockwise rotation of the supports 80 causes the shaft 82 to move the link members 83 counter-clockwise which drives the pins 85 down the grooves 88 in the straight slot sections 92 and then up into the angled slot sections 94. The result of the pins 85 traversing the full length of the grooves 88 is that the shaft 82 follows the pins 85 without rotating on its own axis while the pins 85 are in the straight slot sections 92, but when the pins 85 enter the angled slot sections 94 the shaft 82 is caused to rotate about its own axis counter-clockwise. Since the opening horns 84 and 86 are fixedly secured to the shaft 82, the horns 84 and 86 are caused to rotate counter-clockwise about the axis of the shaft 82, as seen in FIG. 13. The result of the rotation of the horns 84 and 86 on the back panel 116 is seen in FIG. 14, i.e. the back panel 116 is raised further upwardly to virtually guarantee that the enclosure documents 22 have free entry into the envelope 24*a*. The path of travel of the horns 84 and 86 causes the horns 84 and 86 to be dropped onto the open flap 64. The first contact point is before the smallest throat of the smallest envelope to be handled. The horns 84 and 86 then are caused to slide down the inside back surface of the envelope, i.e. the flap 64 and the front panel 118, until the horns 84 and 86 have passed beyond the deepest throat opening to be handled. The horns 84 and 86 are then caused to be raised until the envelope 24*a* is positively opened, as seen in FIG. 14.

Figure 15:
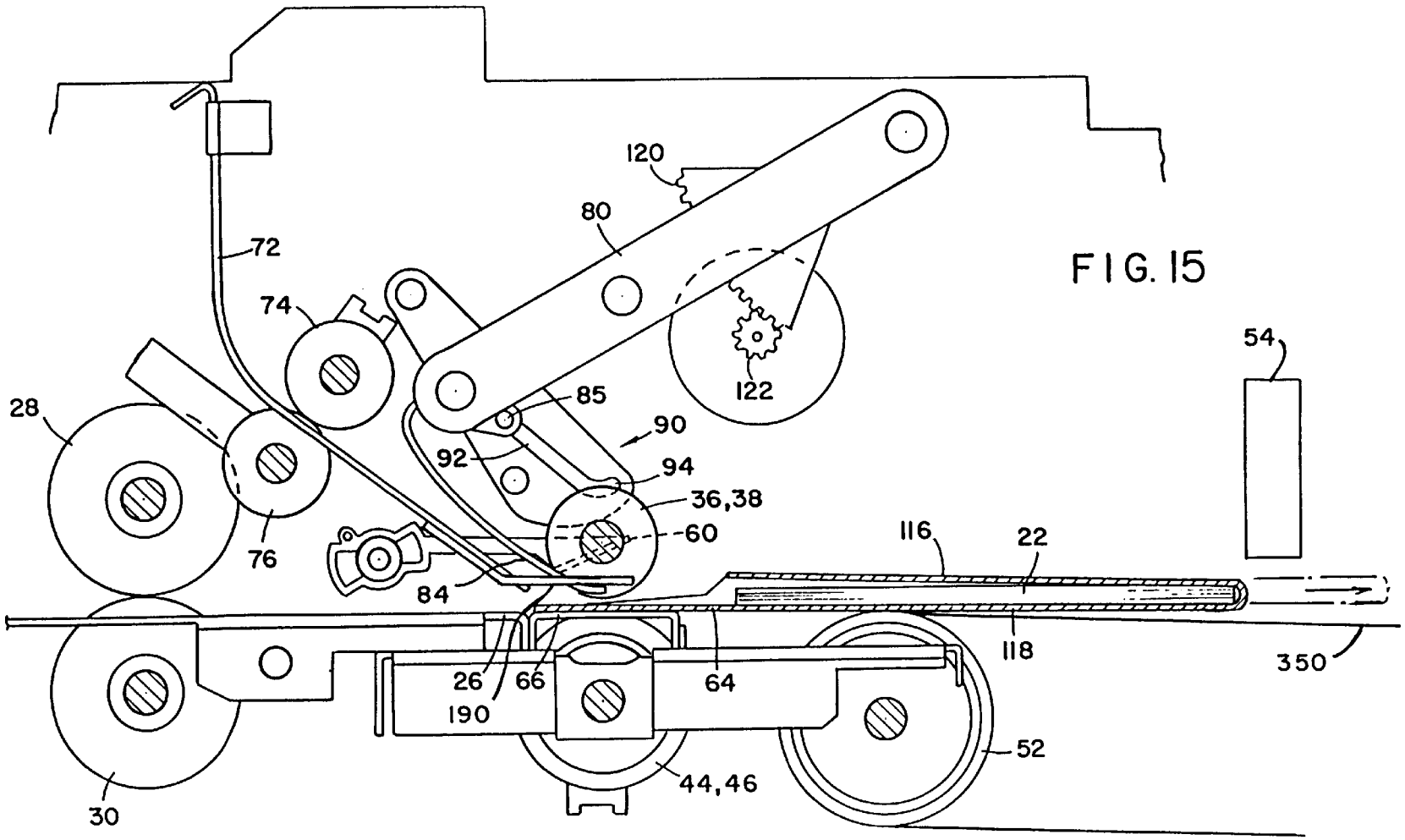
FIG. 15 is similar to FIG. 14 but shows the enclosure documents fully inserted in the envelope and the opening horns retracted from the envelope.

While the envelope 24*a* is being opened as described hereinabove, the enclosure documents 22 are being fed along the chute 72 toward the insert feed rollers 74 and 76 which convey the documents 22 to the feed rollers 36, 38, 40 and 42. The leaf spring 190 holds the enclosure documents 22 in driving contact with the upper feed rollers 36, 38, 40 and 42, the lower drive rollers 44, 46, 48 and 50 being in their lowered position. Accordingly, the feed rollers 36, 38, 40 and 42 convey the enclosure documents 22 into the waiting envelope 24*a*, as seen in FIG. 15. The time for this insertion process to occur is approximately 400 to 500 milliseconds. The inboard friction pads on the flippers prevents the back panel of the envelope being pushed forward as the enclosure documents 22 are driven into the waiting envelope.

The horns 84 and 86 are shaped so that they will pass under the shaft 32 on the outside of the rollers 36 and 42 (see FIG. 7), but close enough to the rollers 36 and 42 to be inside the smallest envelope to be handled. If desired, a third horn could be located on the centerline between the rollers 38 and 40.

Although the foregoing description shows a pair of pivotable supports 80 and associated linkage to the shaft 82, the envelope opening apparatus can function well with only a single support 80, a single link member 83, a single pin 85 and a single groove 88.

Once the envelope 24*a* has been filled with the documents 22, as seen in FIG. 11, the vertically translatable envelope stop 54 is caused to be raised (by means not shown). At the same time, both the hold down fingers and the lower rollers 44, 46, 48 and 50 are raised to release the filled envelope, which is transported from the insertion station 20 along the upper surface of the conveyor 350 to exit the inserter into a collection bin or the like, diagrammatically shown at 259 in FIG. 1.

It should be understood by those skilled in the art that various modifications may be made in the present invention without departing from the spirit and scope thereof, as described in the specification and defined in the appended claims. For example, whilst reference is made hereinabove to stuffing an envelope with a collation, it will be appreciated that the inserter is versatile in operation and can be set so as to feed a single sheet, or a plurality of sheets, with or without folding, in each case with or without one or more inserts. Alternatively, the inserter can be used to place other documents, such as an insert or plurality of inserts only within the envelope.

We claim:

1. An envelope opening apparatus for opening an envelope having rear and front panels and a flap hinged to the front panel comprising:

locating means for locating an envelope in a waiting position with the envelope flap in an open position in substantially the same plane as the envelope front panel, and depression means operable for forming a depression in the envelope flap, so as to cause the rear panel of the envelope to separate from the envelope front panel wherein the depression means includes at least one elongated arm having an offset flange wherein the elongated arm is configured to have two parallel surfaces with an intermediate surface connecting the two parallel surfaces and being substantially perpendicular to the two parallel surfaces located on one side of the elongated arm, the elongated arm being pivotally mounted above the locating means and the offset flange being movable towards the locating means to form said step-like deformation in the flap of the envelope located in the locating means.

2. An apparatus according to claim 1, wherein the offset flange of the elongated arm carries a friction pad.

3. An apparatus according to claim 1, further including means for arching the front panel of the envelope away from its rear panel.

4. An apparatus according to claim 1, further including at least one horn that is operable to be displaced between the separated front and rear of an envelope and then further displaced to further separate the envelope rear panel from the front panel.

* * * * *